US007536807B2

(12) United States Patent
Baier

(10) Patent No.: US 7,536,807 B2
(45) Date of Patent: May 26, 2009

(54) METHOD AND DEVICE FOR SAFE OPERATION OF A PROGRAM-CONTROLLED LAUNDRY DRIER

(75) Inventor: Carsten Baier, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1 day.

(21) Appl. No.: 11/274,552

(22) Filed: Nov. 15, 2005

(65) Prior Publication Data

US 2006/0107547 A1 May 25, 2006

(30) Foreign Application Priority Data

Nov. 19, 2004 (DE) ..... 10 2004 055 940

(51) Int. Cl.
*F26B 11/02* (2006.01)

(52) U.S. Cl. ..... 34/601

(58) Field of Classification Search ..... 34/601, 34/442

See application file for complete search history.

(56) References Cited

U.S. PATENT DOCUMENTS

| | | | | |
|---|---|---|---|---|
| 2,727,315 | A * | 12/1955 | Candor | 34/543 |
| 3,239,945 | A * | 3/1966 | Cobb et al. | 34/527 |
| 3,733,712 | A * | 5/1973 | Smith | 34/532 |
| 3,890,719 | A * | 6/1975 | Braga et al. | 34/572 |
| 4,488,363 | A * | 12/1984 | Jackson et al. | 34/572 |
| 5,187,879 | A * | 2/1993 | Holst | 34/261 |
| 5,852,881 | A * | 12/1998 | Kuroda et al. | 34/527 |
| 6,968,632 | B2 * | 11/2005 | Guinibert et al. | 34/602 |
| 2004/0055176 | A1 * | 3/2004 | Yang et al. | 34/549 |

FOREIGN PATENT DOCUMENTS

| | | |
|---|---|---|
| DE | 10 2004 055 940.6 | 11/1904 |
| DE | 1 585 962 | 9/1969 |
| DE | 197 32 932 | 2/1998 |
| DE | 197 28 068 | 1/1999 |
| DE | 101 63 185 | 7/2003 |
| DE | 101 63 200 | 7/2003 |
| WO | WO 2004/022836 | 3/2004 |

* cited by examiner

*Primary Examiner*—Stephen Gravini
(74) *Attorney, Agent, or Firm*—James E. Howard

(57) ABSTRACT

A program-controlled laundry drier equipped with a rotary drum in which the material to be dried is inserted and moved during the drying process. The dryer comprising a heater for heating the drying air and a blower which guides the drying air stream into the interior of the drum. The axis of a current generator is mechanically coupled to the rotary drum and the output voltage of the current generator is applied to the excitation winding of a relay whose switching contacts switch the heating current circuit for the drying air.

19 Claims, 2 Drawing Sheets

METHOD AND DEVICE FOR SAFE OPERATION OF A PROGRAM-CONTROLLED LAUNDRY DRIER

Figure 1:
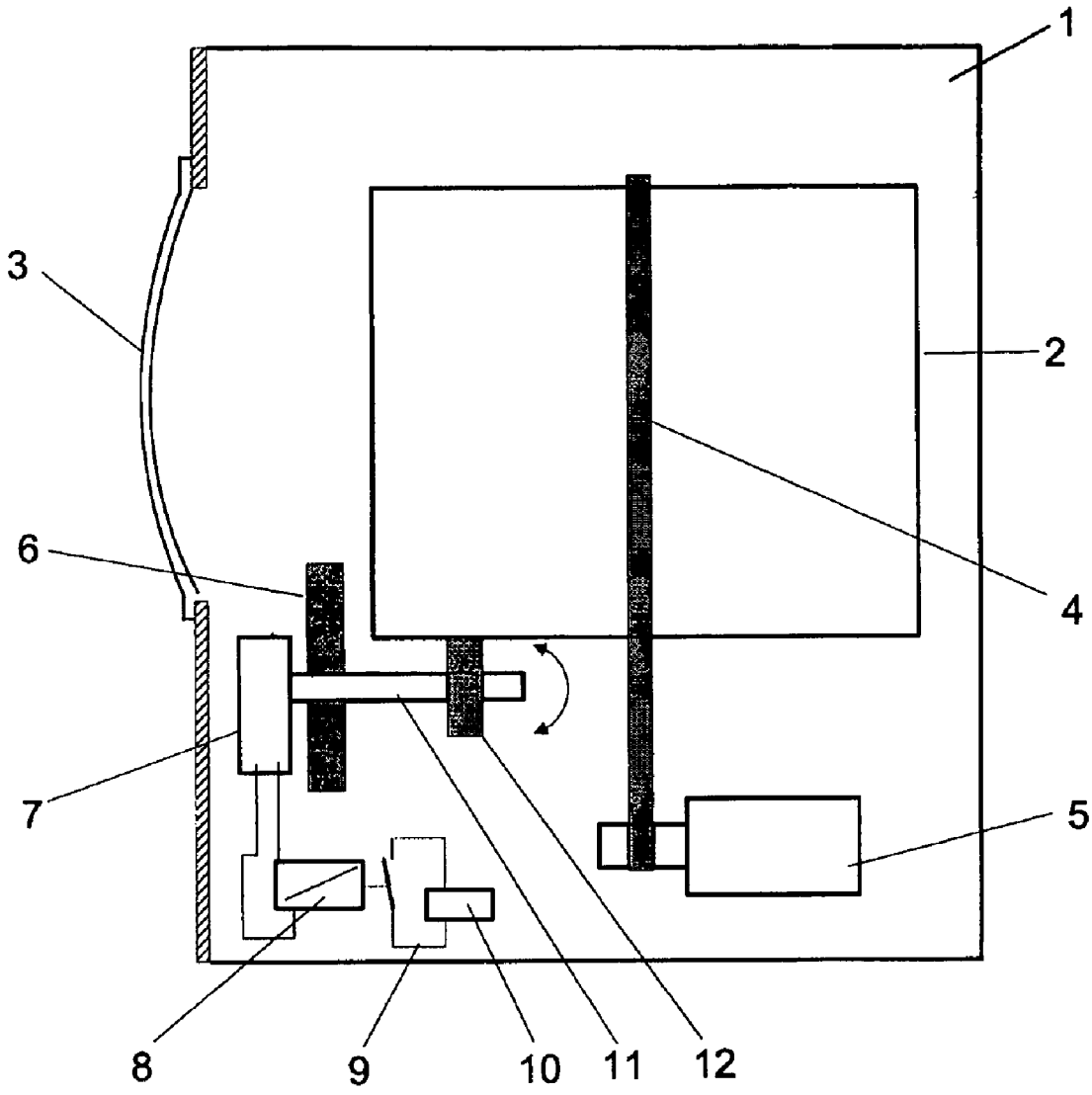

The invention relates to a method for safe operation of a program-controlled laundry drier, especially a method for identifying disturbances of the drum movement and for switching the heating current for the drying air as a function of the rotary movement of the drum and a laundry drier which implements the method. The invention starts from a program-controlled laundry drier wherein the material to be dried is inserted and moved during the drying process, comprising a drive unit for the drum, a heater for heating the drying air and a blower by which means the drying air stream is guided into the interior of the drum.

Laundry driers with a rotatable drum in which the material to be dried is moved and exposed to heated drying air are in use in numerous embodiments. As a result of the continuous circulation of the material to be dried in the drum, on the one hand a uniform drying process is achieved and on the other hand, this yields the possibility of being able to work at high drying air temperatures whereby the drying process is considerably shortened.

On the other hand, a very highly heated drying air stream conceals the risk that in the event of disturbances which cause the drum to come to a standstill or result in severely slowed movement of the drum, the material to be dried can be partially heated too severely and thus be damaged. In order to obviate this, methods and devices have been developed for identifying a stoppage of the drum and interrupting or reducing the drying air stream or the heating for the drying air in the event of such a disturbance.

Known from DE 101 63 185 is a method and device of this type where an optical device is used to detect the rotary movement of a drum. The drum is equipped with reflection markers which reflect the light from a radiation source to a receiver. The output signals of an optical sensor used as a receiver are evaluated inside the control system. The radiation reflected to the receiver is dependent on the speed of the drum. In the event of variations in the received light which can be attributed to disturbances of the drum motion, the heating for the drying air stream is switched off or its power is reduced.

The functional safety of such a contact-breaking arrangement depends on the reliable detection of the optical measurements and their correct analysis by the internal control system of the appliance. There is a risk that, for example, as a result of dirt on the reflection markers or the light receiver, the signal recording will be falsified, which can result in misinterpretations in the internal control system of the appliance and as a consequence thereof, switch-offs can occur when the running of the drum is otherwise free from perturbations.

It is also disadvantageous that the light source used, the reflection markers and the light receiver are additional components which are installed exclusively for monitoring the running of the drum. In addition to the acquisition costs, the expenditure especially for the assembly of the individual components and their alignment is very high. Such a monitoring device is uneconomical overall.

In a laundry drier described in DE 197 32 932 A1 a crack or a slippage of a drive belt connecting the drive motor to the laundry drum is determined by a comparison of the motor speeds when the motor is loaded and unloaded. In the event of a crack in the belt, the unloaded motor runs at a significantly higher speed. The variation of the speed is detected by an irregularity detection device and triggers a signal for switching off the motor on identifying a fault. Since the motor is at the same time the drive for the blower, the process air stream is also interrupted when switching off the motor, so that laundry now lying at rest in the drum cannot be overheated.

A disadvantage is that when the process air stream is interrupted, the heating current is not switched off automatically which can result in overheating and as a consequence thereof, in damage to the heater and the housing surrounding the heater.

Known from DE 15 85 962 A is a switching device which is independent of the control unit of the laundry drier and of additional measured value recording means. The signal which switches off the heating is brought about by a purely mechanical device. In the known laundry drier, the drive motor is disposed on a pivoted lever such that the drive belt for the drum is tensioned by the intrinsic weight of the motor. The switching process which switches off the heating device of the laundry drier is triggered in the event of a crack in the drive belt by a pivoting movement which is executed by the unloaded motor as a result of its gravitational force. For this purpose, the pivoting movement of the motor is transmitted to a ram which is connected to a mechanically movable protective switch.

A condition for the operating mode of the device is a pivotable arrangement of the drive motor which disadvantageously results in a restriction of the design possibilities for installation of the motor.

DE 197 28 068 A1 describes a similar mechanical contact-breaking device where a switch disposed in the electric circuit of the electrical supply to the heating is actuated by the pivoting movement executed by a pivoting lever acting as a tensioning member in the event of a crack in the drive belt.

The mechanical contact-breaking mechanisms described are very robust in their mode of operation and barely susceptible to external disturbances. It is also advantageous that the switching mechanism functions independently of the appliance control system. In modern appliances means for tensioning the drive belt are only used to a limited extent. The elasticity and tensioning force of the belt remain permanently almost unchanged over the operating time of the laundry drier with the materials used today. Spring-force or gravity-loaded tensioning elements are no longer required in the present state of the art. Thus, the logical double function as tensioning and safety element is lacking in the devices described.

The important disadvantage of the previously described mechanical solution variants is that these are exclusively designed for a crack in a belt. All other feasible faults which result in the laundry drum coming to a standstill or severely slowed rotary movement are not detected. In particular, faults at the motor and its power supply, sticking of the drum and possible other sources of faults cannot be detected. In these cases, the heating current for the drying air is not switched off so that damage to the material being dried cannot be eliminated. In order to nevertheless ensure an emergency switch-off of the heating in the laundry drier in every event of a fault, additional devices must be installed for the aforesaid sources of faults.

The invention is based on the object of providing a method for monitoring the drum movement and for switching off the heating for the drying air in the event of any perturbation of the drum motion and means for implementing the method.

According to the invention, this object is solved by a method for safe operation of a program-controlled laundry drier according to the features of claim 1 and means for implementing the method according to the features of claim 6. Further features and advantageous solutions are contained in the respectively following dependent claims.

According to the invention, the rotating movement of the drum is transmitted by mechanical coupling to a device which switches the heating current for heating the drying air, where it is advantageous to convert the rotating movement of the drum into an electrical signal by at least one intermediate module which then effects the switching process.

In an embodiment of the invention, the switching signal for the drying air heating current is generated as a function of the speed of the drum. Associated therewith is the advantage that the heating current is switched off not only when the drum comes to a standstill but also in the event of any significant slowing of the drum movement. Below a minimum speed of the laundry drum the heating current remains switched off so that any start-up delay, for example, caused by overloading the laundry drum, automatically delays the switch-on of the heating current.

The important advantage of the invention is that by applying the invention in the event of any fault which causes the laundry drum to come to a standstill or results in a significant slowing of the drum motion, the heating current for the drying air is switched off and that in the event of any fault which results in a slowed start-up of the drum, switching on the heating current is delayed. The function of the invention is independent of the cause of the fault.

The same applies for any program-controlled interruption and any program-controlled slowing of the drum movement.

The heating current for heating the drying air is advantageously switched independently of the appliance internal control system. As a result, in a further embodiment of the invention, switching of the heating current by the appliance internal control system is completely dispensed with. The heating current is switched on and off by means of the drum which is set in motion by means of the drive motor and by means of the drive belt. In this case, the appliance internal control system only switches the drive device for the drum.

In many appliances, in order to be able to save energy, the temperature of the drying air stream is regulated to low values as a function of the degree of drying of the laundry which is achieved, by means of the control device of the laundry drier with the disadvantageous consequence that the drying process is lengthened. However, the energy expenditure for the entire process is reduced considerably. No restrictions for the use of the invention are obtained for such regulations of the temperature of the drying air stream. The invention can be used regardless of the magnitude of the heating current and can thus also be applied for this case of usage.

The method is preferably implemented by the axis of a current generator being mechanically coupled to the rotary drum and the output voltage of the current generator being applied to the excitation winding of a relay whose switching contacts switch the heating circuit for the drying air. Such a contact-breaking device is extraordinarily robust with respect to faults.

In one constructively simple variant of the solution, the current generator is rigidly connected to a guide roller in the front area of the drier which is used for retaining and guiding the laundry drum by means of a common axis with the current generator. Instead of the usual bearing in the guide roller, the common axis is received by a bearing in the end plate. The expenditure for implementing the invention can thus be reduced to a minimum. The components which must necessarily be additionally used to realise the invention in this embodiment are a dynamo and a relay. These are not sensitive to contamination and vibration whereby the device is extraordinarily reliable. In the event of faults nevertheless occurring in the inventive contact-breaking device, these do not have disadvantageous consequences for the material to be dried. A cable break in the electrical leads, for example, brings about an interruption of the excitation current for the relay and thus always effects an interruption of the heating current for the drying air.

In the preferred embodiment the switching signal for the drying air heating current produced using the switching device according to the invention is dependent on the speed of the drum. The switching point for the heating current is speed-dependent and can be arbitrarily adjusted within wide limits. In order to ensure that even in the event of high temperatures of the drying air, damage to the material to be dried caused by inadequate movement in the drum is always avoided, the switching point can lie slightly below the nominal speed of the laundry drum predefined by the program, i.e., it can be specified such that the switching-off process is triggered even if the drum movement is slightly delayed. The switching point can be adjusted by suitably selecting the two modules, especially by matching the characteristic data of the current generator and the relay to one another. An additional switching expenditure is unnecessary.

The invention and further possible embodiments are explained in detail hereinafter with reference to a preferred exemplary embodiment. The relevant drawings show:

In FIG. 1: a side sectional view of a laundry drier

Figure 2:
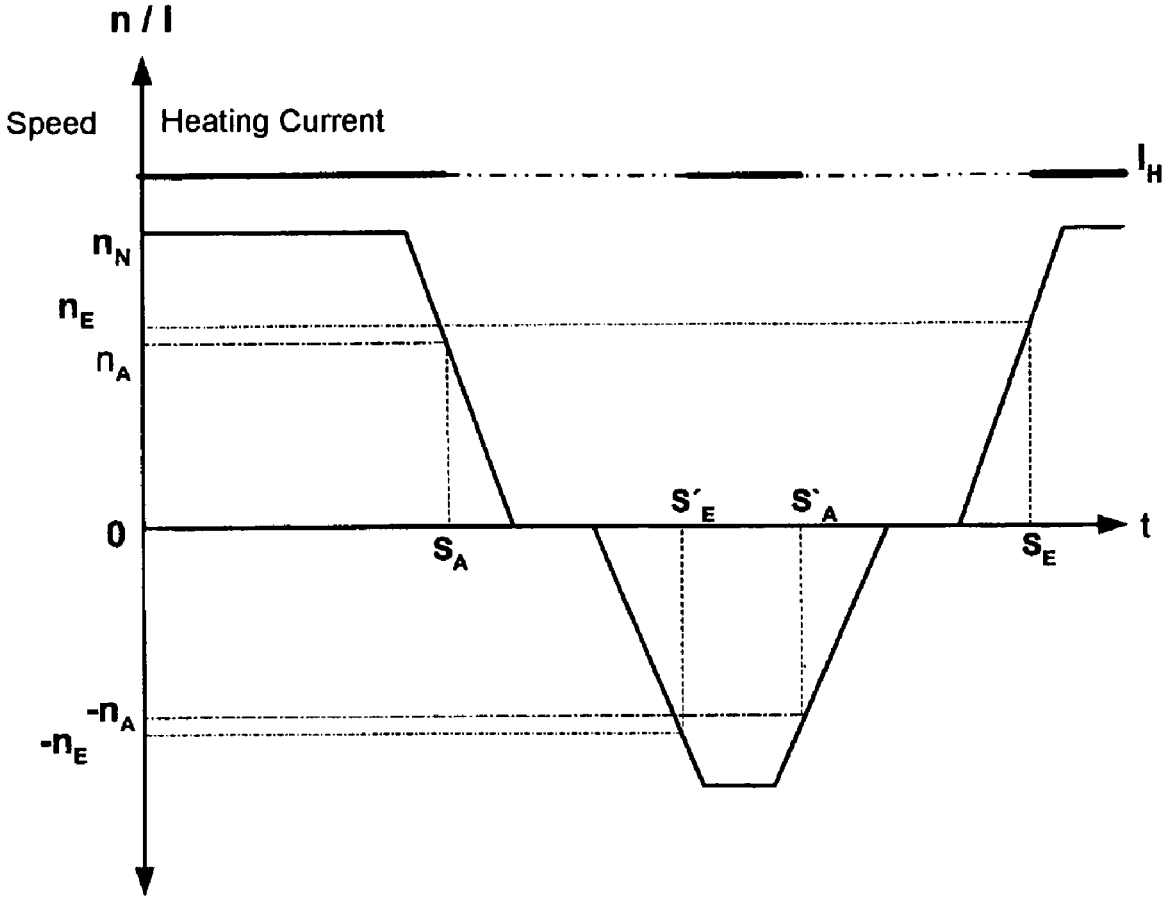

In FIG. 2: a time diagram for a reversingly operated laundry drum

As a preferred example, FIG. 1 shows a laundry drier 1 with a front loading opening via which the material to be dried is inserted into the laundry drum 2 and removed after the end of the drying process. The rear wall of the drum has a plurality of openings via which the drying air stream is guided into the interior of the drum. The heating for the drying air and the blower for circulating the drying air are not shown in the drawing. The drive motor 5 and the laundry drum 2 are connected to one another so that they are free to rotate by means of a sufficiently pre-tensioned drive belt 4. For guidance of the drum 2 and for load bearing, at the front the drum 2 lies on two guide rollers 12 which are disposed in the lower area of the end plate 6. A dynamo 7 is affixed in a torsion-free manner opposite to one guide roller 12 on the other side on the end plate 6. The common axis 11 of the dynamo 7 and the guide roller 12 is mounted in the end plate 6 such that it is free to rotate. In the preferred variant of the solution shown the drive shaft 11 of the dynamo 7 at the same time functions as a rigid receiver for the bottom roller 12 whereby the device is constructively simplified and can be manufactured more cheaply.

The rotary movement of the laundry drum 2 is transmitted by means of the guide roller 12 and the common axis 11 of guide roller 12 and dynamo 11. The pressure exerted by the laundry drum 2 on the guide roller 12 and the frictional force thereby induced are always sufficient to reliably drive the dynamo 7 even when the loading of the laundry drum 2 is very low.

The dynamo 7 is electrically connected to a relay 8 whose electrical contacts lie in the electrical supply line 9 for the heating 10. When the laundry drum 2 is at a standstill, the switching contacts of the relay 8 are opened and the power supply 9 to the drying air heating 10 is interrupted. When the laundry drum 2 is rotating, a current is produced by the mechanical coupling via the support roller 12 and the common axis 11 in the dynamo, which current, above a minimum current intensity, i.e. when the speed of the laundry drum 2 is sufficient, brings about the closure of the relay switching contacts and thus switches on the heating 10 for the drying air stream.

The electrical power generated by the dynamo 7 depends on the rotational speed of the laundry drum 2. The dynamo 7 and the relay 8 located thereafter are selected so that at nominal speed of the laundry drum 2 the relay 8 picks up reliably and the heating circuit 9 for the process air stream is closed. Dynamo 7 and relay 8 are matched to one another with regard to their ratings so that even in the event of a slight reduction in rotational speed, a drop-out of the relay 8 and therefore an interruption of the heating current 9 are brought about. This results in the possibility of being able to operate at relatively high drying air temperatures depending on the condition of the material to be dried and the drum speed during the drying process. This would shorten the drying process without thereby running the risk that in the event of operating faults or delayed start-up of the drum, the material to be dried can be damaged as a result of insufficient circulation and as a consequence thereof, partially too severe heating.

By using the device according to the invention, it is possible to switch the heating current during the entire drying process not as usual through the appliance internal control system but indirectly via the rotational movement of the laundry drum 2, decoupled from the appliance control system of the drier 1. The invention can thus be advantageously applied to reversingly operated laundry drums, i.e., driers 1 whose drum 2 is moved with an alternating direction of rotation during the drying process. The heating current is always switched off by means of the inventive device when the laundry drum briefly comes to a standstill on reversing the direction of rotation or falls below a minimum speed.

In order to explain the operating mode, the behavior of the heating current I is plotted as a function of the drum speed n on a time axis t in the diagram in FIG. 2. At the beginning of the short program section shown with reversal of the direction of rotation, the laundry drum 2 rotates clockwise at the nominal speed $n_N$, the switching contact of the relay 8 is closed and a heating current $I_H$ flows, its magnitude being controllable as a function of the degree of drying of the laundry. At the time $S_A$ the laundry drum 2 falls below the minimum speed $n_A$ required to generate the current intensity in the dynamo 7 which keeps the switching contacts of the relay 8 closed. The relay 8 drops out, the opening switching contacts interrupt the heating circuit 9. After re-starting the drum 2, the relay 8 and therefore the heating current only switch on again when the minimum speed is reached. In the diagram this switching point is designated as $S_E$ for clockwise rotation and by $S_E'$ for anticlockwise rotation of the laundry drum 2. The corresponding drum speeds $n_E$ and $-n_E$ are of the same magnitude. The drum speeds $n_A$ and $n_E$ for the switch-off point $S_A$ and the switch-on point $S_E$ can differ slightly from one another, these hysteresis-induced slight deviations of the speeds for $S_A$ and $S_E$ being of no importance for the function of the inventive contact-breaking device. The same applies to anticlockwise rotation. In the event that the required speed for switching is not reached during brief anticlockwise rotation, the heating circuit 9 remains switched off for this program phase.

The switching points $S_A$ and $S_E$ for interrupting and switching on again the heating circuit 9 are speed-dependent and can be arbitrarily varied over a relatively wide range by specifically selecting the ratings of dynamo 7 and relay 8. In particular, the switching points as a function of the maximum heating power can always be located near the pre-determined nominal speed $n_M$ so that the circulation of the material to be dried by the rotational movement of the laundry drum 2 is certainly adequate to avoid any damage to the laundry to be dried by the hot process air.

REFERENCE LIST

1. Laundry drier
2. Laundry drum
3. Drier door
4. Drive belt
5. Motor
6. End plate
7. Dynamo
8. Relay
9. Heating circuit
10. Heating system
11. Axis
12. Guide roller

The invention claimed is:

1. A laundry drier equipped with a housing and a rotary drum defining a drying chamber in which a material to be dried is inserted and moved during a drying process, comprising a drive unit for the rotary drum, a heater for heating a drying air stream, a blower for guiding the drying air stream into the drying chamber, means for generating a heating current for heating the drying air stream as a function of a movement of the drum, means for sensing rotational speed of the rotary drum, using a selectively settable rotation sensor, and a trip component operable to interrupt power to the heater when the rotational speed of the rotary drum reaches a predetermined setpoint value.

2. The laundry drier according to claim 1, wherein the drum movement is transmitted by at least one intermediate module including a current generator coupled to the rotary drum.

3. The laundry drier according to claim 2, wherein a primary mechanical signal is converted into an electrical signal by the at least one intermediate module.

4. The laundry drier according to claim 2, wherein a switching signal for the drying air heating current is generated as a function of the speed of the drum.

5. The laundry drier according to claim 2, wherein the heating current for heating the drying air is switched independently of an internal control system of the laundry drier.

6. A method for operating a laundry drier having a housing, a rotary drum supported by the housing for rotational movement with respect to the housing, a heater for providing heated air to the drum, and a selectively settable rotational sensor for detecting the rotational speed of the drum, the method comprising the following acts:

detecting the rotational speed of the drum using the selectively settable rotation sensor; and providing heated air to the drum with the heater in response to the rotational speed being greater than a predetermined setpoint value.

7. The method according to claim 6, wherein the rotational sensor includes a current generator coupled to the rotary drum, the act of detecting the rotational speed comprising:

providing an output voltage from the current generator in response to a rotational movement of the drum, the output voltage being a function of the rotational speed; and applying the output voltage to a relay having switching contacts that switch a heating current circuit for the heater, the heater only being operable when the output voltage is greater than a predetermined setpoint value.

8. The method according to claim 7, wherein the laundry drier includes a primary control system for normal operation of the laundry drier, the heating current circuit for the heater being switched independently of the primary control system.

9. A laundry drier comprising:

a housing;

a rotary drum supported by the housing for rotational movement with respect to the housing;

a heater providing heated air to the drum; and a selectively settable rotational sensor detecting a rotational speed of the drum, the heater being turned off in response to the rotational speed of the drum being reaching a predetermined setpoint value wherein heat generation by the heater is suspended if the rotational speed of the drum deviates from a predetermined setpoint value.

10. The laundry drier according to claim 9, wherein the rotational sensor includes a current generator coupled to the rotary drum and providing an output voltage in response to a rotational movement of the drum, the output voltage being applied to a relay having switching contacts that switch a heating current circuit for the heater.

11. The laundry drier according to claim 10, wherein the switching contacts of the relay are opened in a rest position and the heating circuit for the heater is interrupted.

12. The laundry drier according to claim 10, wherein the switching contacts of the relay are connected to the current generator and are disposed in an excitation circuit of a second relay and the heating circuit of the heater is switched by the second relay.

13. The method according to claim 2, wherein the movement of the drum is mechanically converted to a proportional electrical signal.

14. The laundry drier according to claim 10, further comprising at least one guide roller in a front area of the drier, the guide roller being used for retaining and guiding the drum and being mechanically coupled to the current generator.

15. The laundry drier according to claim 14, further comprising an axis rigidly connected to the guide roller, the axis being rigidly connected to the current generator.

16. The laundry drier according to claim 15, wherein the axis is rotatably mounted in an end plate of the drier.

17. The laundry drier according to claim 14, wherein the guide roller is rigidly connected to a lengthened axis of the current generator.

18. The laundry drier according to claim 17, wherein the lengthened axis is rotatably mounted in an end plate of the drier.

19. The laundry drier according to claim 12, wherein the switching contacts of the relay connected to the current generator are disposed in the excitation circuit of the second relay and wherein the heating circuit is switched by the second relay.

* * * * *